United States Patent [19]

Credle, Jr.

[11] 4,275,823

[45] Jun. 30, 1981

[54] AUTOMATIC CHANGE-OVER SYSTEM FOR LIQUID DISPENSING SYSTEM

[75] Inventor: William S. Credle, Jr., Stone Mountain, Ga.

[73] Assignee: The Coca-Cola Company, Atlanta, Ga.

[21] Appl. No.: 61,254

[22] Filed: Jul. 27, 1979

[51] Int. Cl.[3] ..... B67D 5/34

[52] U.S. Cl. ..... 222/94; 222/95; 222/136; 222/144.5; 222/145; 222/327; 137/113; 137/614.18; 137/625.41

[58] Field of Search ..... 222/94–95, 222/136, 144.5, 145, 335, 325–327, 386.5; 137/113, 119, 614.17, 614.18, 625.41, 265

[56] References Cited

U.S. PATENT DOCUMENTS

| | | | |
|---|---|---|---|
| 1,992,319 | 2/1935 | Maggenti | 137/614.18 X |
| 2,360,839 | 10/1944 | Barksdale | 137/113 |
| 3,533,431 | 10/1970 | Kuenzel et al. | 137/113 |
| 3,825,027 | 7/1974 | Henderson | 137/265 |
| 4,014,461 | 3/1977 | Harvill | 137/265 X |

FOREIGN PATENT DOCUMENTS

| | | | |
|---|---|---|---|
| 2503505 | 8/1976 | Fed. Rep. of Germany | 222/95 |

*Primary Examiner*—Charles A. Marmor

*Attorney, Agent, or Firm*—Birch, Stewart, Kolasch & Birch

[57] ABSTRACT

An automatic change-over system for stock rotation of liquids packages in plural collapsible bag-type reservoirs including an improved automatic change-over valve is described. The bag-type reservoirs are divided into primary and secondary groups, the primary group containing a supply of liquid product which is currently being dispensed and the secondary group containing a supply of liquid product which is held in reserve. An automatic change-over between the primary and secondary groups of bag-type reservoirs is effected in response to a vacuum created by an empty condition in the bags in the primary group. A pressure change in the system results from the deflation of the empty bag-type packages which switches the change-over valve. Thus, the change-over is caused by the characteristics of the flexible bags containing the liquid being dispensed and the valve mechanism which connects the primary group, the secondary group and a dispensing pump together.

8 Claims, 4 Drawing Figures

AUTOMATIC CHANGE-OVER SYSTEM FOR LIQUID DISPENSING SYSTEM

BACKGROUND OF THE INVENTION

1. Field of the Invention

The present invention relates to a system for stock rotation of liquids, such as soft drink syrups, contained in collapsible bag-type reservoirs or replaceable packages. More specifically, the present invention relates to an improved automatic change-over valve for automatically switching between a primary supply reservoir and a secondary supply reservoir in response to an empty condition of the primary reservoir.

2. Description of the Prior Art

Heretofore the stock rotation or changing of liquid bag packages such as milk, soft drink syrups or chemicals, has been accomplished by manual methods. When the contents of a package are exhausted, the pump system was not supplied with liquid until the packages could be manually changed. This caused unavoidable, unexpected and inconvenient delays in the dispensing operation. To provide for larger reserves many prior art systems connected packages in a parallel arrangement. However, this parallel arrangement does not provide for the necessary stock rotation required by many perishable food items such as milk and soft drink syrups. By contrast, conventional rigid type sealed packages have inlet and outlet openings and are often connected in series. However, this system also does not provide for a complete rotation of the liquid products since mixing occurs. Furthermore, if bag packages according to the present invention were connected in series, they would not provide for reserve capacity but only a large initial capacity, since the bag packages would collapse equally unless assisted by gravity or other external means.

Automatic change-over devices for non-viscous liquids disposed in open or vented rigid containers are known in the prior art. However, these devices are not satisfactory for automatic stock rotation of viscous liquids contained in flexible bag packages. Furthermore, many liquids tend to crystalize when exposed to air in open systems, this further complicates container rotation. Bag packages, according to the present invention, overcome the deficiencies of the prior art containers by providing a sealed and closed system to air and other outside contaminates.

For example, an automatic change-over system for gas contained in a primary and secondary bank of storage tanks is disclosed in U.S. Pat. No. 2,968,162 to Acomb issued Jan. 17, 1961. The Acomb system effects a change-over from one group of supply tanks to another in response to pressure changes caused by an empty condition of the tanks being dispensed. However, the Acomb system does not possess the necessary sensitivity to automatically dispense more viscous liquids, such as syrups, in a fast and reliable manner.

Another similar type of automatic change-over system is disclosed in U.S. Pat. No. 3,825,027 to Henderson. In the Henderson system, the change-over sensitivity is enhanced by the provision of ball float valves 34, 36 in the respective primary and secondary supply circuits. The Henderson system works very well for dispensing liquid fuels of low viscosity, this being the purpose for which it was designed. However, the float valves tend to stick due to sugar build-up when the liquid being dispensed is a viscous liquid such as soft drink syrups.

Another automatic change-over device for a liquid dispensing system is disclosed by Harvill, U.S. Pat. No. 4,014,461 and assigned to the same assignee as the present invention. Harvill discloses an automatic change-over system for stock rotation of a liquid product packaged in collapsible bag-type reservoirs. However, the automatic change-over valve employed in the system disclosed by Harvill is rather complicated and extremely bulky.

SUMMARY OF THE INVENTION

Accordingly, it is a primary object of the present invention to provide a device whereby two separate systems of single or multiple packages may be rotated automatically as the product contained therein is dispensed, allowing for package changes to be made when time is available.

It is another object of the present invention to provide an automatic change-over device having the necessary sensitivity for dispensing viscous liquids such as syrup.

It is a further object of the present invention to provide an automatic change-over device suitable for dispensing liquids disposed in flexible bag reservoirs.

A still further object of the present invention is to provide a relatively simple, uncomplicated automatic change-over valve for selectively switching between primary and secondary groups of bag-type reservoirs in response to a vacuum created by the empty condition in the bags of the primary group.

The objects of the present invention are fulfilled in part by virtue of the inventor's discovery that a relatively simple, uncomplicated automatic change-over valve may be employed together with a plurality of collapsible bag-type packages. The automatic change-over valve is connected to a dispensing pump and to a primary group of flexible bag packages and a secondary group of flexible bag packages. The automatic change-over valve connects the dispensing pump initially to the primary group of flexible bag packages to deflate the flexible bags while dispensing the product contained therein. After the product contained within the primary group of flexible bags is dispensed, a single check valve which includes a spring biased member is opened in response to a pressure differential on the opposite side thereof. Thereafter, liquid products positioned within the secondary flexible bag packages will be dispensed from the system through the automatic change-over valve. Subsequently, the automatic change-over valve may be manually rotated so as to provide an unobstructed flow path between the secondary group of flexible bag packages and the dispensing pump. In this position, the primary group of flexible bag packages may be disconnected from the automatic change-over valve and replaced with full, fresh, flexible bag packages.

These and other objects will become apparent from the detailed description given hereinbelow. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
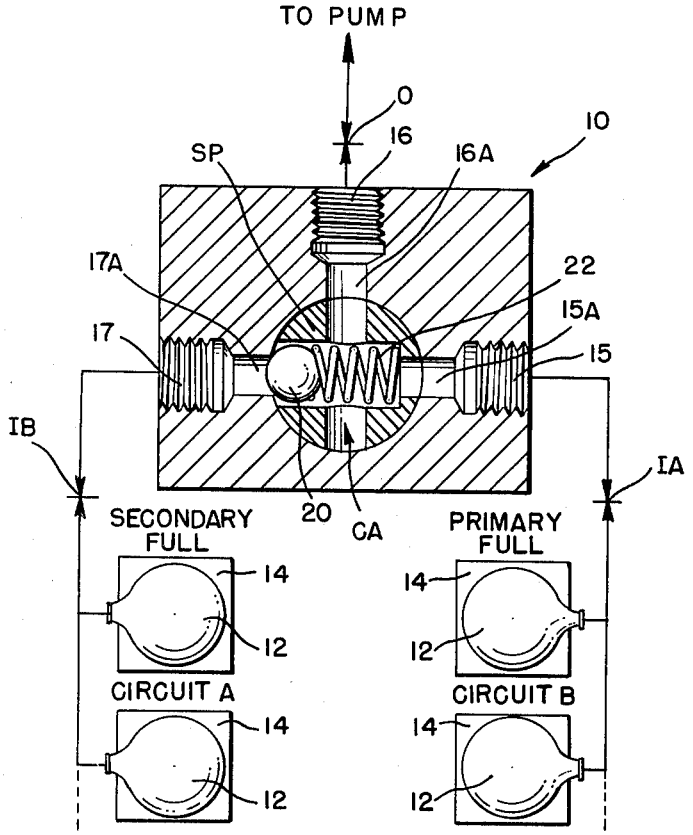
FIG. 1 is a diagrammatic view illustrating the dispensing system of the present invention with both the primary and secondary supply circuits in a full condition.
Figure 4:
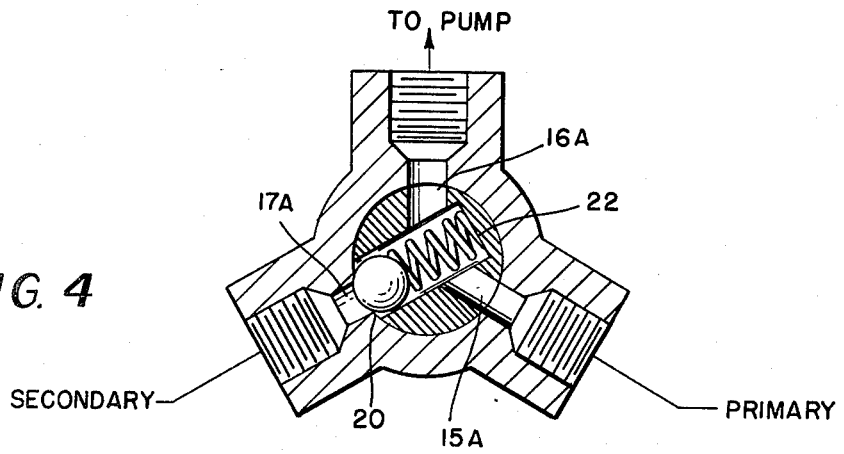
FIG. 4 is a cross-sectional top view of the automatic change-over valve which shows that orientation of ports relative to each other does not have to be 90°.

Referring in detail to FIG. 1, there is illustrated a primary supply reservoir of flexible bag packages generally designated circuit A. A similar set of bag packages comprise a secondary supply reservoir and are generally designated circuit B. In the condition shown, these packages are both full prior to the commencement of the dispensing operation.

Each of the bag packages include flexible bags 12 disposed within outer rigid boxes 14 of types that are well known in the art for containing milk, syrup or liquid chemicals of a similar nature.

The bag packages from primary circuit A or secondary circuit B, during a dispensing cycle, are selectively connected to a pump P at outlet O through an automatic change-over valve generally indicated by character 10. The primary circuit A is connected to an inlet IA of the automatic change-over valve 10 and secondary circuit B is connected to an inlet IB of the automatic change-over valve 10.

Change-over valve 10 includes three ports 15, 16 and 17. The port 15 provides a connection opening for attaching the circuit A. The port 17 provides a connection opening for attaching the circuit B. The port 16 provides a connection opening to attach the pump P.

The change-over valve 10 includes three conduits 15A, 16A and 17A which connect the ports, 15, 16 and 17, respectively, to a rotary spool SP. The rotary spool SP is centrally disposed in the change-over valve 10 and is designed to permit an unobstructed path between two of the conduits. The rotary spool SP includes a spring biased valve member CA which include a ball 20 and a spring 22. It should be noted, that an equivalent check valve, such as, an umbrella check, a duckbill check, or numerous other types of check valves could be employed in place of the check valve CA without departing from the spirit or intent of the present invention.

Figure 2:
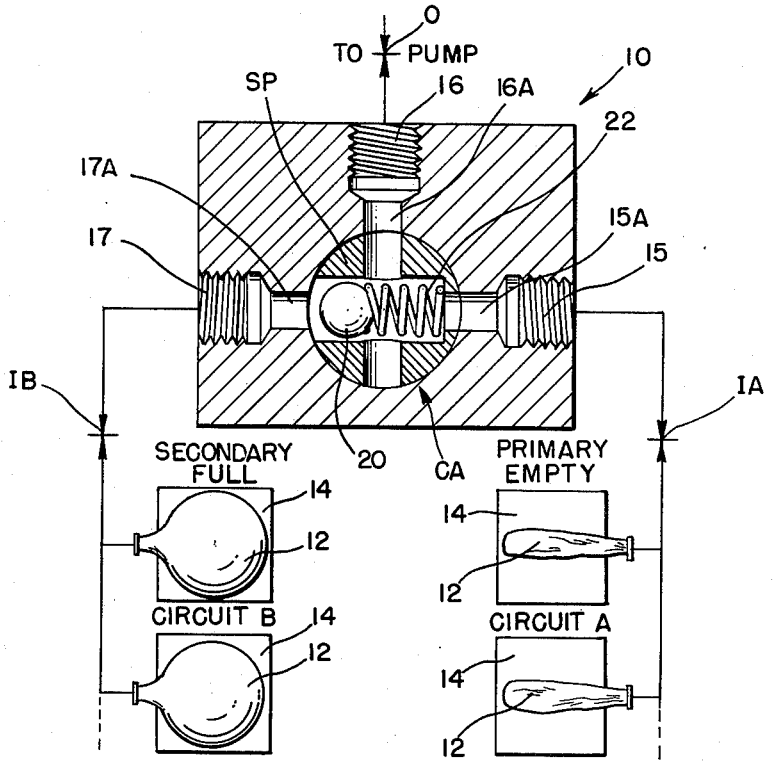
FIG. 2 is a diagrammatic view of the system of FIG. 1 illustrating the primary supply circuit in an empty condition and the secondary circuit in a full condition.

Referring in detail to FIG. 2, there is illustrated the identical system to FIG. 1, with the exception that the bags 12 in the primary circuit A are in an empty state and are therefore deflated. As further described in FIG. 2, the deflation of bags 12 in the primary circuit A causes a significant pressure drop or vacuum in the lateral conduit 15 and the conduit 16 which causes the ball 20 of the check valve CA to open. Upon opening of the check valve CA a flow of liquid product from the secondary circuit B is initiated via the inlet IB, the conduit 17A, the conduit 16A to the pump P. In this manner, as will be further described hereinafter, an automatic change-over from the primary circuit A to the secondary circuit B is effected.

Upon automatically changing from the primary circuit A to the secondary circuit B, the secondary circuit B then becomes the primary circuit and the primary circuit A then become the secondary circuit. Once this automatic change-over has stabilized, the rotary spool valve SP is rotated for connecting the lateral conduit 17A to the central conduit 16A. The rotation of the rotary spool valve SP can be effected manually and is rotated through 180°.

After the rotary spool valve SP is rotated 180° so as to provide an unobstructed path between the lateral conduit 17A and the central conduit 16A, the ball 20 is positioned adjacent to the lateral conduit 15A to obstruct the path between the lateral conduit 15A and the other two conduits 16A and 17A. While in this condition, the bag packages of what was the primary circuit A can be refilled without having any detrimental effects on the dispensing cycle in progress.

Figure 3:
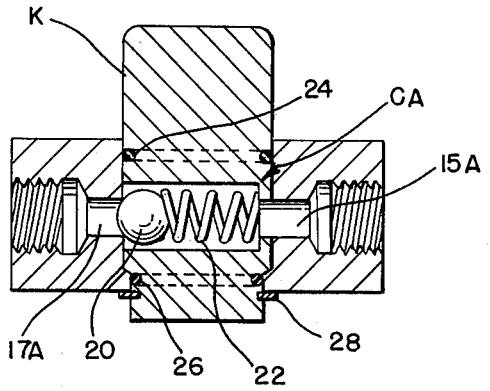
FIG. 3 is a partial cross-sectional side view of the automatic change-over valve according to the present invention.

The details of the assembly of the mechanical components of a preferred embodiment of the automatic change-over valve 10 of FIGS. 1 and 2 is illustrated in detail in FIG. 3. As illustrated, the valve includes a common block or housing containing the necessary internal bores or conduits 15A, 16A and 17A. The internal conduits provide a selective connection to either the inlet IA from circuit A or the inlet IB from circuit B to the outlet O connected to a dispensing pump P.

Disposed within a transverse passage or bore is a rotary spool valve SP which may be rotated to selective dispensing positions by the knob K. The rotary spool valve SP is positioned within the transverse bore in a sealed condition by means of O-rings 24, 26 disposed adjacent to the upper and lower portions of the spool valve. In addition, a spring clip 28 retains the spool valve SP in the valve assembly so as to properly align the conduits 15A, 16A and 17A with the openings in the spool valve SP.

As illustrated in FIG. 3, the check valve CA is disposed in a horizontal bore or passage in substantial alignment with the conduits 15A and 17A. In this position, liquid product positioned within the circuit A may be pumped therefrom through the spool valve SP and the outlet O to the pump P. As mentioned hereinabove, after the liquid product positioned within the circuit A is exhausted, the pressure created within the system will bias the ball 20 to the right thereby opening the conduit 17A for communication with the conduit 16A. In this manner, the liquid product positioned within the circuit B is in communication to be dispensed through the outlet O to the pump P.

DESCRIPTION OF OPERATION

One can readily understand the operation of the automatic change-over valve in the system of the present invention with reference to FIGS. 1 and 2. In FIG. 1, both the primary circuit A and the secondary circuit B are full. In this condition, the dispensing pump P easily removes liquid from the primary circuit A through the rotary spool valve SP in the position shown, since there is no major obstruction or pressure working in opposition to the pump P. Also, in this position it can be readily observed that the secondary circuit B is obstructed by the closed check valve CA. The pump P will continue to operate only from the primary circuit A until all of the liquid product is exhausted.

Referring to FIG. 2, when the flexible bags 12 of the primary circuit A are collapsed, the pump P in conjunction with the collapsed state of the bags 12 creates a substantial pressure decrease or vacuum within the rotary spool valve SP so as to bias the ball 20 against the spring 22 in the check valve CA and thereby open the check valve CA. Once the check valve CA opens, liquid from the bag packages in circuit B, which was initially the secondary circuit, can be pumped through the outlet O via the inlet IB, the conduit 17A, the rotary spool valve SP, the conduit 16A to the outlet O and the pump P.

During routine stock inventory or inspection of the bag packages, an attendant would become aware of the collapsed or empty state of the bags 12 in what was the primary circuit A. The rotary spool valve SP would then be rotated to change the primary designation and logic to circuit B. Circuit B now become the primary circuit and the rotary spool valve SP is rotated to a position wherein the ball 20 is engaged in the conduit 15A. The attendant can then remove the empty bag packages from the circuit A without affecting the operation of the dispensing system in any way. New packages may be connected in circuit A when convenient and when connected become the secondary supply of liquid to be dispensed.

Thereafter, when the packages of the circuit B become empty and collapse into a deflated state, the check valve CA will open in response to the vacuum created in the lateral passage 17A. Thereafter, liquid product within the circuit A will flow through the conduit 15A, the open check valve CA and the rotary spool valve SP and through the conduit 16A to the outlet O and the pump P. The process may be repeated over and over again by switching the primary side with the rotary spool valve SP and changing the respective bag packages in circuits A or B.

It should be understood, that the system described herein may be modified as would occur to one with ordinary skill in the art without departing from the spirit and scope of the present invention.

What is claimed is:

1. In an automatic change-over device for a liquid dispensing system including, first and second sets of at least one collapsible bag for containing a liquid to be dispensed, each of said collapsible bags having a first volume when full and deflating to a second volume when empty, and pump means for drawing said liquid out of said first or second sets of collapsible bags when in circuit with said first or second sets, respectively, the improvement comprising:

a change-over valve means in circuit between said first and second sets of bags and said pump means for providing selective communication therebetween, said change-over valve means including a single pressure sensitive check-valve which is normally closed for selectively providing an obstruction between said second set of bags and said pump means in an initial position and for selectively providing an obstruction between said first set of bags and said pump means in a second position, said single pressure sensitive check-valve means being opened in said initial position in response to a pressure change created by said second volume of said first set of bags, said single pressure sensitive check-valve means being opened in said second position in response to a pressure change created by said second volume in said second set of bags, and means for transferring by a force other than said pressure changes, said single pressure sensitive check-valve means between said initial and second positions to selectively provide said obstruction in either the initial or second positions.

2. In an automatic change-over device according to claim 1, wherein said single pressure sensitive check-valve means is a ball element biased to a normally closed position by spring means.

3. In an automatic change-over device according to claim 1, wherein said means for transferring comprises a rotatable valve element including a through conduit with said single pressure sensitive check-valve means operatively disposed therein and a central conduit in communication with said through conduit and said pump means.

4. In an automatic change-over device according to claim 1, 2 or 3, wherein said change-over valve means is a rotary spool.

5. In an automatic change-over device according to claim 1, wherein said change-over valve means is disposed in a housing having first and second inlet passages coupled to said first and second sets of bags, respectively, said change-over valve means including a through conduit with said single pressure sensitive check-valve operatively disposed therein and a central conduit in communication with said through conduit and in communication with an outlet conduit coupled to said pump means.

6. In an automatic change-over device for a fluid dispensing system including housing means having first and second inlet passages and an outlet passage for communicating a fluid from said inlet passages to a dispensing device, the improvement comprising:

a rotatable valve element journalled in said housing and including a through conduit, a single pressure sensitive check-valve means operatively disposed therein, and a central conduit in communication with said through conduit and said outlet passage, said valve element being rotatable between an initial position wherein said check-valve means controls fluid flow from one of said inlet passages to said outlet passage and a second position wherein said check-valve means controls fluid flow from the other of said inlet passages to said outlet passage, said single pressure sensitive check-valve means being normally closed for selectively providing an obstruction between said one of said inlet passages and said outlet passage in an initial position and for selectively providing an obstruction between said other of said inlet passages and said outlet passage in said second position, said single pressure sensitive check-valve means being opened in said initial position in response to a predetermined pressure differential across said one of said inlet passages, said single pressure sensitive check-valve means being opened in said second position in response to a predetermined pressure differential across said other of inlet passages.

7. In an automatic change-over device according to claim 6, wherein said rotatable valve element is a spool.

8. In an automatic change-over device according to claim 6, wherein said single pressure sensitive check-valve means includes a ball element biased to a normally closed position by spring means.

* * * * *